US008422934B2

(12) United States Patent
Penke et al.

(10) Patent No.: US 8,422,934 B2
(45) Date of Patent: Apr. 16, 2013

(54) ILLUMINATED OUTPUT PRESENCE INDICATOR

(75) Inventors: Mark S Penke, West Henrietta, NY (US); Debora Margaret Hejza Litwiller, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 591 days.

(21) Appl. No.: 12/410,908

(22) Filed: Mar. 25, 2009

(65) Prior Publication Data

US 2009/0207018 A1 Aug. 20, 2009

Related U.S. Application Data

(63) Continuation of application No. 11/272,128, filed on Nov. 10, 2005, now abandoned.

(51) Int. Cl.
*G03G 15/00* (2006.01)

(52) U.S. Cl.
USPC ..... 399/405; 271/215

(58) Field of Classification Search ..... 399/405; 271/215
See application file for complete search history.

(56) References Cited

U.S. PATENT DOCUMENTS

| | | | | |
|---|---|---|---|---|
| 3,966,198 | A * | 6/1976 | Komada et al. | 271/265.02 |
| 4,566,547 | A * | 1/1986 | Furukawa | 177/46 |
| 6,109,604 | A * | 8/2000 | Chu et al. | 271/10.11 |
| 6,412,413 | B1 * | 7/2002 | Tice et al. | 101/409 |
| 6,786,354 | B2 * | 9/2004 | Black et al. | 221/6 |
| 7,775,519 | B2 * | 8/2010 | Takahashi et al. | 271/258.01 |
| 2005/0129437 | A1 * | 6/2005 | Ishikawa | 399/384 |
| 2009/0033030 | A1 * | 2/2009 | Yasumoto | 271/278 |

FOREIGN PATENT DOCUMENTS

JP 01294155 A * 11/1989

OTHER PUBLICATIONS

Translation of Takahiko Nanko et al. JP 01-294155.*
Parent Application U.S. Appl. No. 11/272,128.

* cited by examiner

*Primary Examiner* — Matthew G Marini
*Assistant Examiner* — Allister Primo
(74) *Attorney, Agent, or Firm* — Ronald E. Prass, Jr.; Prass LLP

(57) ABSTRACT

In a production, fax or printing system, collection stations are sometimes obscure to the user. This invention provides a first sensor connected to a light source that illuminates this collection station when a product or copy is present so that the presence of the product or copies to be collected is apparent to a user. A second sensor turns off the light source after a preset period of time so that the light doesn't stay on indefinitely.

7 Claims, 7 Drawing Sheets

ILLUMINATED OUTPUT PRESENCE INDICATOR

This application is a Continuation-in-Part of present pending parent application Ser. No. 11/272,128 filed in the U.S. Patent and Trademark office on Nov. 10, 2005.

FIELD

This invention relates, generally, to collection stations in machines and systems and, more specifically, to marking systems with collection stations.

BACKGROUND

Many collection stations in systems having product transportation from production to a collection point are obscure and sometimes difficult to find. This is true, for example, in marking or printing systems such as in image-forming machines where a marked medium is moved to a collection station. Electrophotography is such a system. Electrophotographic image-forming machines are used to transfer images onto paper or other medium in both printing and facsimile systems. Generally, a photoconductor is selectively charged and optically exposed to form an electrostatic latent image on the surface. Toner is deposited onto the charged photoconductor surface. The toner has a charge, thus it will adhere to the photoconductor surface in areas corresponding to the electrostatic latent image. The toner image is transferred to the paper or other medium. The paper is heated for the toner to fuse to the paper. The photoconductor is then refreshed—cleaned to remove any residual toner and charge—to make it ready for another image. The imaged paper is then passed to a document output collection area or tray where the user collects the finished, permanently imaged paper or documents.

In some of today's newer, complex, multifunctional printers, copiers or fax machines, there is some difficulty in seeing the document output tray because of its obscure location. On these machines, the primary output tray is somewhat hidden as it is generally located directly below the scanner and control panel. Many newer copiers and multifunction devices also utilize a compact architecture which does not leave room for easily observed output trays. The primary output area for copies, prints and faxes is contained within the footprint of the (Image Output Terminal) IOT. This creates a smaller footprint than more traditional approaches which utilize an output tray mounted to the side of the IOT.

A disadvantage is that, because of this obscured output tray, customers often experience difficulty in seeing those printed documents. Control panels located above and in front of the output area often obstruct visibility. Additionally, cast shadows in the recessed output area further disguise the presence of the printed documents. Machines with fax functionality have a compounded problem with obscured output collection stations. This is because in fax machines, users often do not know when a document is being received. This problem exists in electrophotographic and non-electrophotographic machines.

As a result, customers tend to search for their documents or simply are unaware these documents have been delivered to the output area. This leads to both frustration and a loss of productivity.

Some current solutions use a message sent on the user interface (UI) which alerts the user that a job has been completed. The disadvantages in this approach are that the message is spatially disconnected from the actual output area and that the user must take the time to read the message.

Therefore, operators or users have frequent difficulty finding the semi-obscured output area, holding the documents, reducing their ability to find some or all of the finished product.

Also, it is difficult for people with handicaps, such as people sight- or hearing-impaired, to locate the output station containing the documents.

The above is also true in other product delivery systems, especially small products such as nails, screws, pens, pencils, erasers, keys, etc. where the products are moved to an obscured collection station where they are hard to find or the operator is unaware product has been delivered.

SUMMARY

While it is obvious to use or adapt the defined embodiments herein, in any product producing system where a product is transferred or moved to a collection point, electrophotographic systems will be used as examples to clearly illustrate said embodiments herein.

In this embodiment, a light source is located in proximity to the output tray area (collection station) and will illuminate documents in the output tray or collection station. This light would illuminate only when documents are present in the collection station. The light could be color coded to indicate status and various information relating to the copies in the tray. The lamp would light only when a first sensor is directly activated by a paper sheet document and at least one finished document is present in the tray.

There are a variety of ways in which the document output illumination feature can be implemented. They include but are not limited to the following ways.

At least one light source can be mounted either directly above or below the output area on a vertical or horizontal surface located adjacent to the area or in other locations. This illuminated effect can be created through the use of various light bulbs including fluorescent and incandescent, electroluminescent sources or Light Emitting Diodes (LEDs). Additionally, as above noted, colors can be utilized for additional effect and visual impact through the use of filters or through the use of colored LEDs.

In practical application, the LEDs in one embodiment may provide a convenient solution due to low costs, low energy consumption, long operating life, small size, comparative brightness and low heat generation.

The on/off sequence can also be implemented in a number of ways including but not limited to the following:

When a copy, print or fax job in one embodiment is initiated the light source is automatically turned on in response to a signal from a first sensor located at the beginning of the conveyance path. It can stay on until a specified period of time after the completion of the job has passed.

When a copy, print or fax job is initiated in an embodiment, the first sheet out activates a first sensor, either an optical, mechanical or other sensor starting the illumination process. When the operator has removed the copies or sheet(s), a second sensor is activated sending a message to shut off the illumination source.

In one embodiment, when a copy, print, multi-function marking system or fax job is initiated in an embodiment, the first sheet out passes a first sensor located at the beginning of the conveyance paper path, the illumination process is started when a first sheet passes. When the last sheet passes the sensor, a signal is sent to maintain the illumination for a set specified period of time. When it is indicated in the present system that a first sensor and a second sensor is used, this includes at least one first sensor and at least one second sensor.

A variety of sensors can be used successfully in triggering the light activation when paper is deposited in the exit tray. Some examples of sensors that can be used are electromechanical sensors, which would be physically activated by the paper itself, which would then send a signal to the light source for energization. Another type of sensor could be optical, which would have a sender and receiver, which when the paper interrupts the optical beam, would send a signal for the light source to be energized. Another could be a mechanical sensor that utilizes a spring device to make the electrical contact. Obviously, any suitable type sensor or sensors may be used provided at least one first sensor is positioned upstream in the conveyance path and at least one second sensor is positioned downstream (nearer the collection station) in the conveyance path.

Additionally, various combinations of items in the above paragraphs can be utilized.

Through the use of a sensor in operative relationship to the output area, the illumination and other signals may stay on indefinitely until the documents have been removed. This would alert others who may be passing by the machine that a job has been completed.

Should a job be left in the output area for an extended period of time, the lights may flash on and off to conserve energy and to provide an additional way to gather a customer's attention. To be effective, the illumination and other signals must be apparent for easy recognition in normal, artificially and naturally lit work environments. The light or other signals can also be timed to the energy saver mode and turned on or off depending on the energy or sleep mode constraints.

The energization of the exit lights can be utilized for variety of conditions valuable to the user. One is capacity of the tray; color coding of the exit lights could communicate the fill capacity of the exit tray. For example, no paper present, all exit lights off. A small amount of paper present, and a single light or a color light (such as a green light) could be energized. As the tray fills with more paper, an orange light could energize (and the green light would de-energize), or a second light could be energized making the illuminated surface appear more brilliant. Upon max fill levels, a red light could energize (the orange light turns off) indicating max capacity has been reached. Or a third light could energize or another way to communicate max capacity is to blink the light until the paper is removed. In a preferred embodiment of the present invention, the light in the collection station will only stay lighted for a predetermined period of time.

Another use of colored lights could be for identification of the type of job in the tray. For example, a blue light would be illuminated if the paper was an incoming fax job. Or a orange light could be used for print jobs. Lights could also be tied to a person's identification utilizing the device's software a user would have on their PC. For example, using the devices software, a user could tag "Jim's print jobs" to a blue light, and "Sally's print jobs" to a yellow light and so on and so on. When Jim sends a print job, he can easily see from a distance that his job is ready by the blue illuminating light. If Sally sends a job, her light would be illuminated. The user could have the last job sent light be on or select having the lights turn on in sequence to indicate multiple jobs received.

Yet, another use of the exit lights would be to indicate condition. A single color would indicate paper in the tray. A secondary color (such as red) could indicate there is an error condition that needs operator attention.

As earlier noted, any apparatus adapted to produce a product may be used where the apparatus comprises in operative relationship the product producing station and a product conveyance system. The product is moved through the system toward a collection area or station. Along the way, the product directly triggers or energizes a first sensor or sensors whereby the sensor(s) turns on an illumination source adapted to light up the collection station. The sensor can also activate other alerting signals such as audio or vibrating signals. This activation can occur during conveyance of the product to the collection station. A second sensor(s) maintains the illumination for a set period of time, then will automatically shut off.

DETAILED DISCUSSION OF DRAWINGS AND PREFERRED EMBODIMENTS

Figure 1:
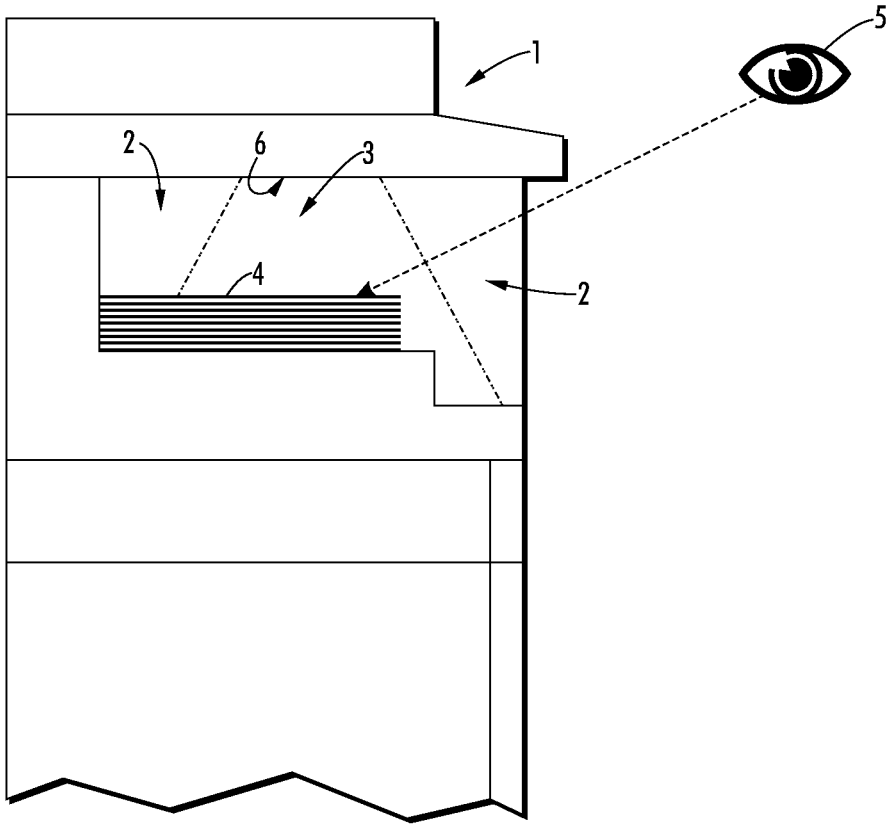
FIG. 1 illustrates in one embodiment a machine having a marked paper collection station where the collection station is illuminated from above.

In FIG. 1, a side view of a fax, printer or reproduction machine 1 is illustrated, depicting a output tray or collection area or station 2 that is not clearly and easily observed. The collection area 2 in this embodiment is illuminated from above by a light source 3 which substantially improves visual observation for user 5 of the output 4 located in the collection station 2. The apparatus or machine 1 is adapted to produce finished output or receiving members or paper 4 transported in a conveyance path or system from a marking station to collection station 2. The apparatus 1 comprises at least two sensors 12 in the interior of machine 1 (an embodiment shown in FIGS. 5 and 6). One of the at least two sensors 12 is operatively connected to a light source 3 which as shown will illuminate the collection station 2 containing the marked paper copy or receiving members 4. One sensor 12A is a first sensor located at the beginning of the conveyance path and a second sensor 12B is located near the end of the conveyance path. See FIG. 7.

Figure 7:
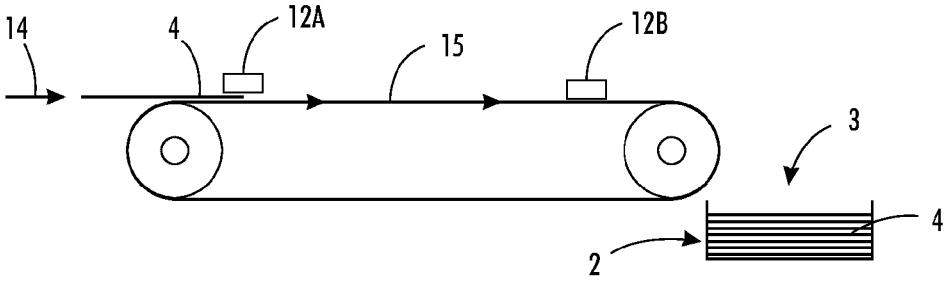
FIG. 7 illustrates an embodiment where at least one first sensor is positioned near the paper feed and at least a second sensor is positioned along the conveyance path near the collection station 2.

The machine 1 can be either electrophotographic or not, or can be an electrophotographic printer, copier, duplicator, facsimile, communication system or multi-function machine or other machine that delivers a product to a collection area. By multi-function system is meant an apparatus that can function as a copier, a printer, a computer network, a facsimile, or a communication device. The word "printer" as used herein encompasses any apparatus such as a digital copier, bookmaking machine, facsimile machine, multi-function machine, etc. which performs a print outputting function for any purpose. Although a monochrome printing apparatus has been described herein, the claims can encompass embodiments that print in color or handle color image data. While the location of the sensor 12 or sensors 12 can be anywhere along the paper conveyance path of the machine, specific locations are in the paper path, at least one near the paper feed 14 and at least one near the collection station 2, as shown in FIG. 7. Suffice it to say that the important first sensor 12A feature is that it can directly activate lighting source 3 in addition to other signals later described. In this embodiment light source 3 is mounted at location 6 above the copies 4. The light source 3 can be at least one fluorescent light(s), incandescent light (s), electro-luminescent light(s), light emitting diodes (LEDs) and any combination of these. The location of light source or signal 3 can be any suitable location in or in proximity to the collection station 2. Also, the sensors 12 can be an electrical sensor, a mechanical sensor, an optical sensor, other suitable sensors or any mixtures of these. It is important that the first sensor 12A (see FIG. 7) be capable when triggered by sheet 4, of both activating only a light source 3 to illuminate the collection station 2, or to activate light source 3 together with other suitable signals such as audio signal 7 and vibrating signal 8 as shown in FIG. 3.

Figure 2:
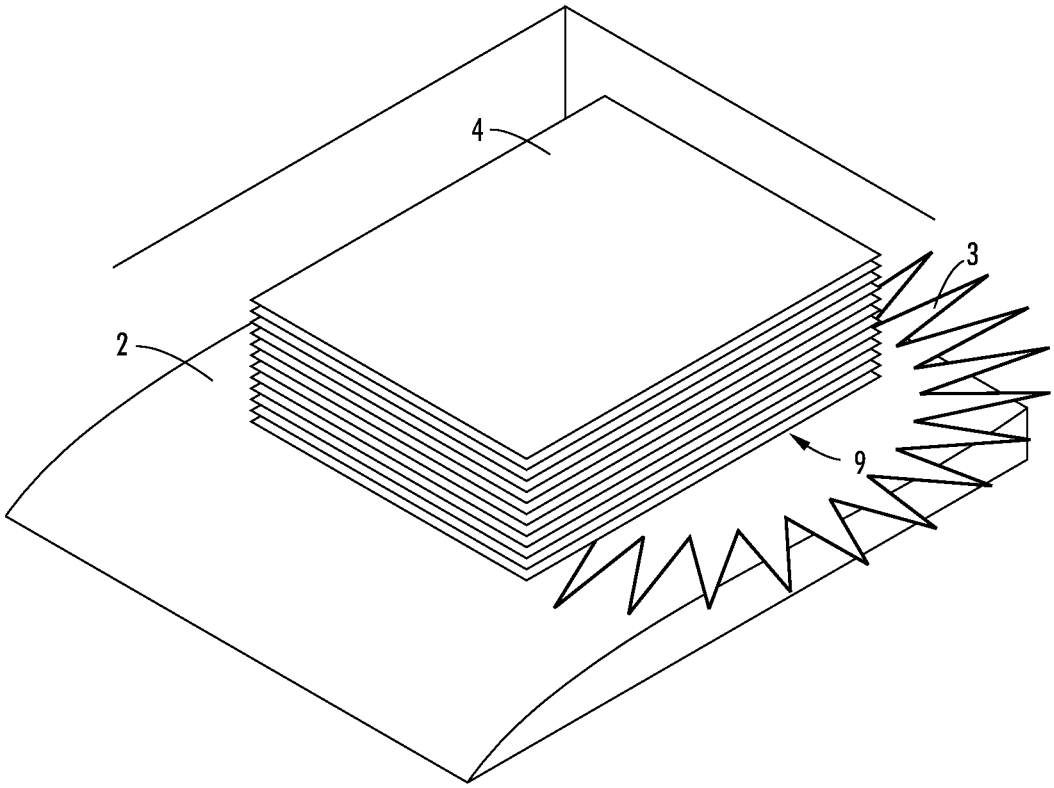
FIG. 2 illustrates in one embodiment a product or paper output tray having a marked paper product collection station that is illuminated from below.

In FIG. 2, the light source 3 is provided below or in the lower portion 9 of the collection station of a marking or production system. The product from a production system or documents 4 from a printer will become more apparent to the user if collection station 2 is illuminated. "Product" as used herein includes any product from a production system that is moved to a collection station where a sensor or sensors indicates its presence.

Figure 3:
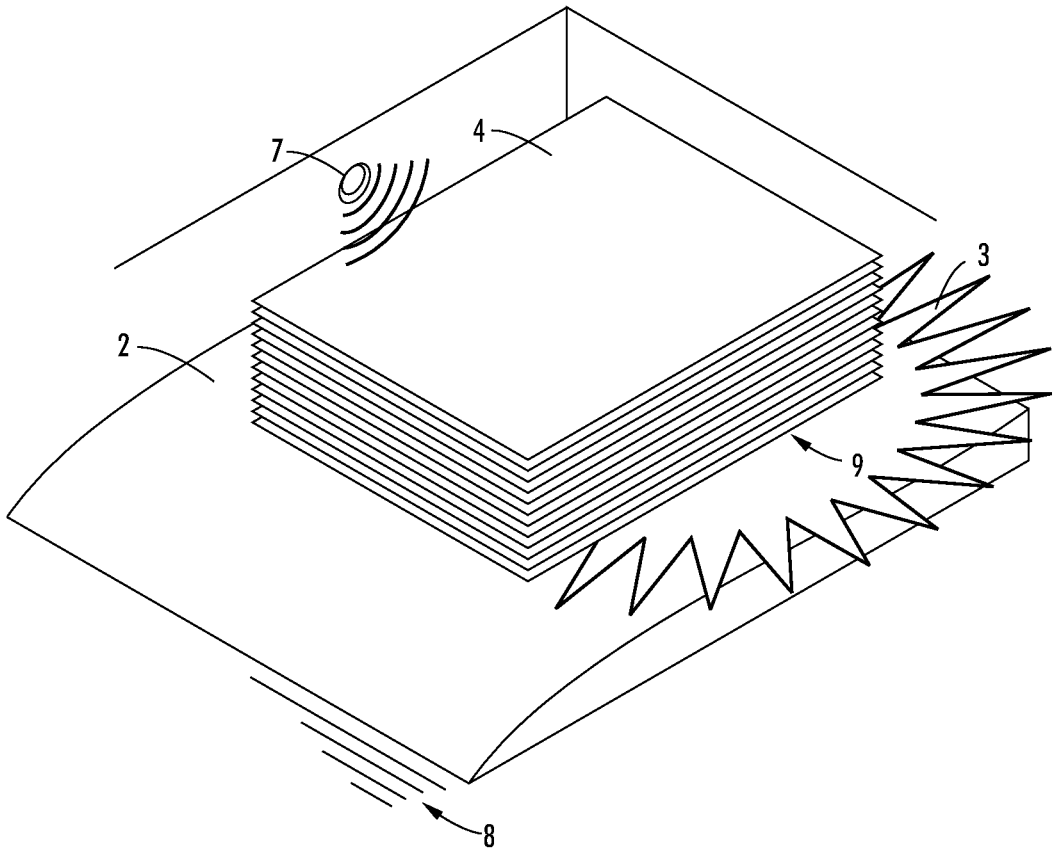
FIG. 3 illustrates in one embodiment a product or paper output tray having an illumination signal, an audio signal and a vibration signal.

In FIG. 3 a light source 3 is illustrated for use together with audio signal 7 and vibrating signal 8. The product or the marked receiving members or paper 4 collect in collection station 2 at the completion of or during a job. The sensor(s) 12 activate light source 3 together with either or both audio signal 7 and vibrating signal 8, or any other suitable signal. These signals can be activated during and after a job in the machine 1 is completed or, in a preferred embodiment, for a predetermined time. The machine 1 in one embodiment is a multi-function reproduction machine.

Figure 4:
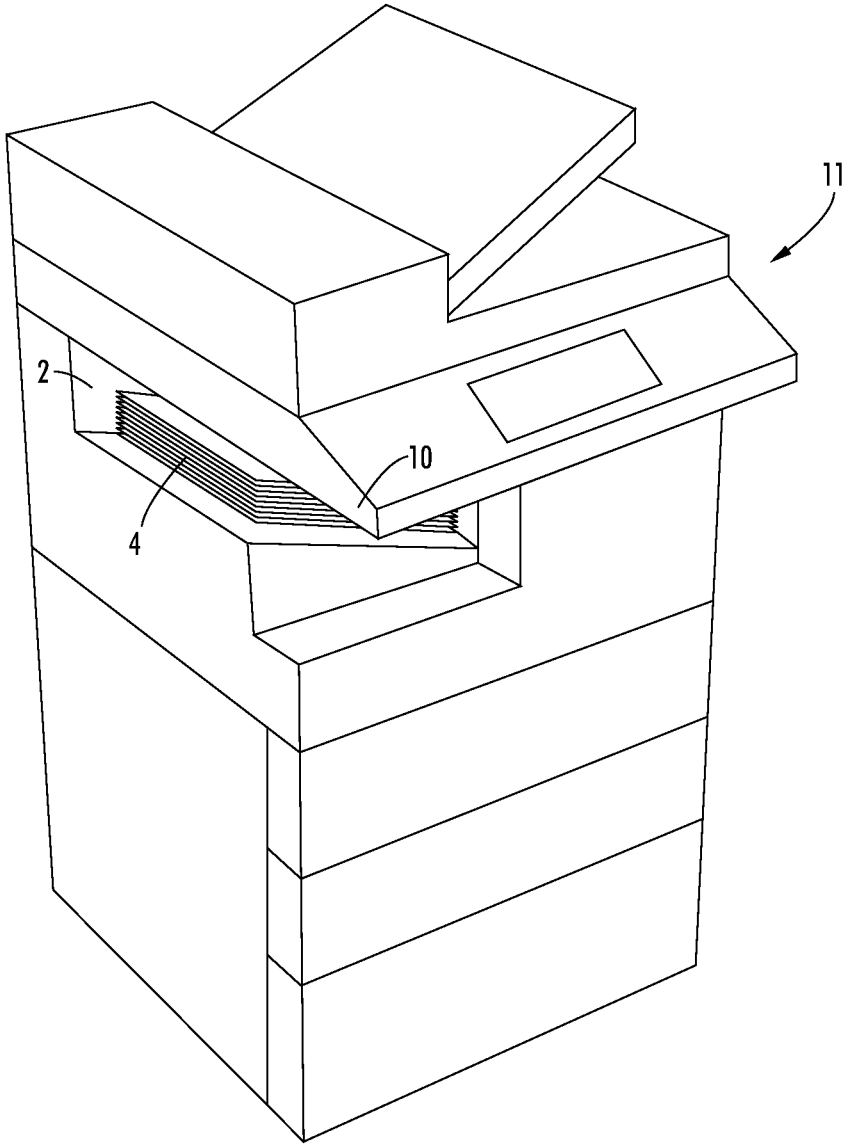
FIG. 4 illustrates a typical prior art fax or copier machine having an obscured output tray or product collection area.

In FIG. 4, a typical prior art machine 11 with prior art non-illuminated collection station 2 is shown. Note that the collection station 2 is not readily observable because usually it is indented and under overhanging panel 10. Documents 4 are easily and commonly left in collection station 2 because of its obscure location. Also, handicapped people can have a particularly difficult time locating finished documents 4.

Figure 5:
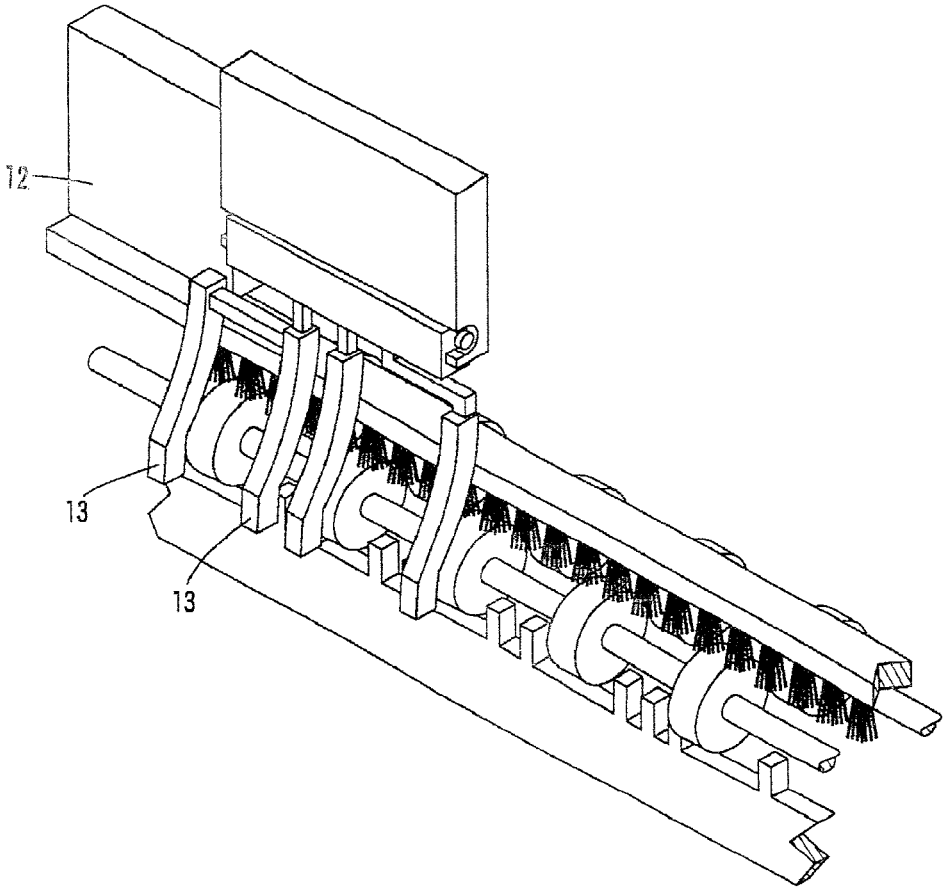
FIG. 5 illustrates an embodiment where a sensor located along the travel path of a product or copy is in an inactive position.

In FIG. 5, a portion of the product or paper path of a document is shown where sensors 12 are in a rest or inactive position. The sensors 12 comprise movable arms 13 that will be moved and rise into an active position once a product, paper or receiving member 4 makes direct contact therewith and pushes arms 13 upwardly to an activation position.

Figure 6:
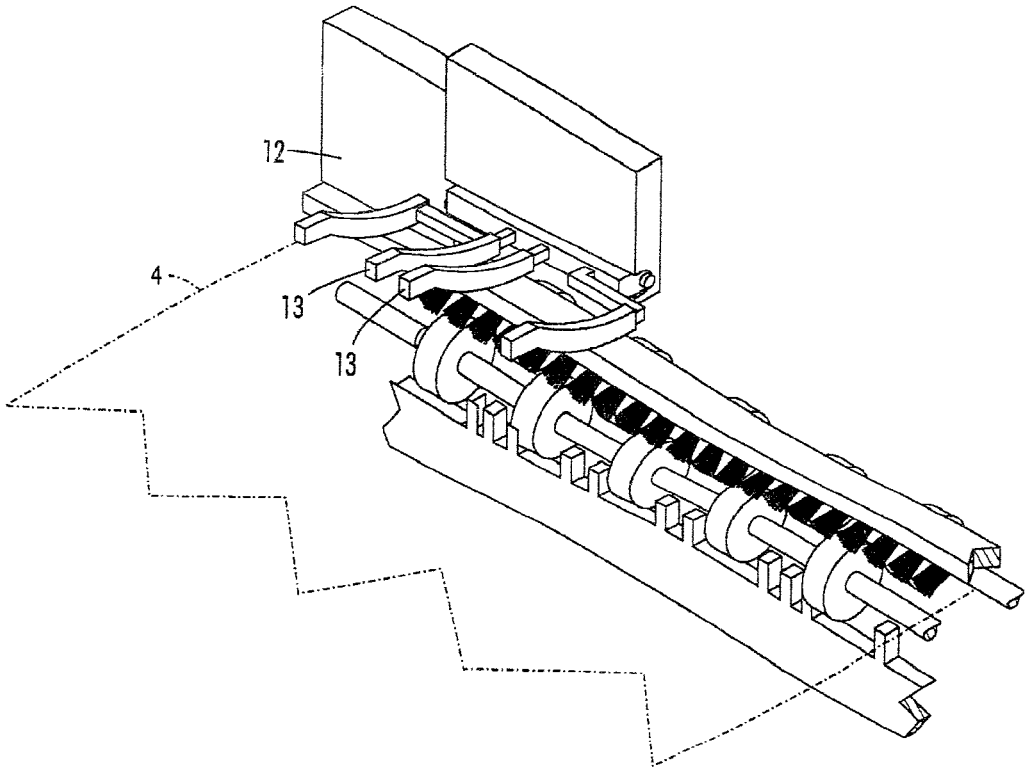
FIG. 6 illustrates in the embodiment of FIG. 5 this same sensor along the travel path of a product or copy where the sensor activates illumination of the output station.

In FIG. 6, arms 13 of the sensors 12 are pushed upward when a product or sheet of paper 4 passes there through forcing movable arms 13 upward in an activating position. At this activating position, one of the sensors 12 activates or turns on light source(s) 3 to illuminate the collection station 2. As earlier noted, once activated, the one of the sensors 12 can also turn on or activate audio alarm or signal 7 and vibrating 8 signals. As noted earlier, other suitable sensors and signals may be used together with sensors 12.

FIG. 7 shows a system having a sensor at least at both a beginning point or near a beginning point on said conveyance path 15 and a sheet end point or near an end point of said path 15. Sensor(s) 12A is positioned on paper path 15 near marking station feed 14 and sensor(s) 12B is located at a sheet end point of path 15 near collection station 2. Sensor 12B is configured to inactivate a signal 3 and shut off the signal at a predetermined or fixed period of time after the first sensor 12A is activated and turns on the signal 3. First sensor 12A is configured to activate a signal 3 when a first sheet enters the path 15 and the sheet 4 directly triggers or energizes the sensor 12A to illuminate station 2 and sensor 12B turns off the signal 3 after a preset time including illumination source 3. It is important that paper 4 directly triggers off or activates sensor 12A and directly triggers off or inactivates sensor 12B as paper 4 comes in communication with the sensors. Once the initial communication is made, the sensor 12A activates signal 3 to illuminate the station 2, then sensor 12B is activated when the paper 4 is in communication with 12B. Once 12B is activated, the signal 3 is activated for only a predetermined period of time then the signal 3 is automatically turned off. This is important since in the prior art systems the signal remained active until all the paper was removed from the collection station, and will stay on indefinitely like over a week and until all the paper is removed from the collection station. Obviously, more than one first sensor 12A and more than one sensor 12B may be used, if suitable.

In summary, the present invention provides a marking system that comprises at least two sensors, a marking station, a sheet(s) collection station with a signal, a sheet conveyance path, and said at least two sensors separated positioned along the conveyance path. One of said sensors is configured to activate at least one signal including illumination at said collection station. The conveyance path is configured to convey the paper along the path extending from the marking station and ending before a paper exit. The paper exit is enabled to allow the sheets to pass therethrough into the collection station.

Located along the sheet conveyance path and before the collection station is positioned a first and a second of the sensors. The first sensor(s) is configured along said conveyance path to activate the signal when a first sheet passes therethrough. This first sensor is configured to be directly triggered or activated by the paper. A second sensor(s) is positioned along the conveyance path and configured to inactivate the signal and shut off the signal at a pre-determined or fixed period of time after the first sensor is activated. The signal is selected from the group, consisting of illumination or light means, color coded lights, audio signals, vibrating signals and mixtures thereof. The second sensor is configured to shut off the signal in the collection station at a preset time after activation by the first sensor.

In this system or apparatus at least one of the first sensors is located near a beginning point on the path and at least one of the second sensors is located near a sheet end point of the path near the collection station. The illumination may be color coded to indicate various information relating to the sheets, including a number of the imaged document in the collection station.

In one embodiment the illumination will flash to provide an additional means to attract a user's attention. The first and second sensors in the path are selected from the group consisting of electronic sensors, optical sensors, mechanical sensors, and mixtures thereof. The sheet or imaged document is moved through the system along the path, this path having at least one sensor immediately after the marking station and at least one sensor immediately before the collection station and wherein the sheet triggers or energizes at least one of these sensors and at least one of these sensors turns off the signal after a preset time, including an illumination source at the collection station.

One embodiment of this invention provides a printing apparatus comprising in an operative relationship at least two sensors, at least one marking station, a conveyance path or system configured to move a marked sheet from a marking station to at least one copy output area or collection station, and a lighting or light source in operative contact with at least one of these sensors which is configured to illuminate the copy output area to indicate the presence of at least one finished marked copy in the output area.

The first sensor is located in the apparatus near the marking station and at a beginning of said conveyance path and operatively connected to signals including at least a light source, the light source configured to illuminate the output area for a preset time during and after a copy reproduction job in said apparatus is completed.

This apparatus comprises a machine selected from the group consisting of multi-function machines, printers, duplicators, and facsimile. This apparatus comprises at least two sensors, a first sensor positioned at a beginning of the conveyance path and a second sensor positioned at an end of said conveyance path. The first sensor is configured to be activated upon direct contact with the marked sheet, and the second sensor is configured to turn off the signal for a preset time after the sheet passes through the second sensor.

While this invention has been described by embodiments relating to facsimile machines and electrophotographic copiers, printers and duplicators, obviously other machines that produce products or copies can utilize the present invention. Therefore, the present invention includes any apparatus adapted to produce a product or finished documents of at least one marked receiving member. This apparatus comprises in operative relationship at least one product producing station or marking station and a conveyance system which is enabled to move said product or receiving member from said product producing or marking station to a collection station. This apparatus comprises at least two sensors configured to indicate the presence of at least one of said products or receiving members in said collection station. A first sensor is operatively connected to at least one light source which is adapted to illuminate said collection station containing said receiving members during and after production of said products or marking of said marked receiving members is completed and said product or receiving members are deposited in said collection station. The light source is activated alone or together with other signals such as audio signals and vibrating signals. A second sensor located at an end portion of the conveyance path will automatically turn off the signal after a predetermined time period.

It will be appreciated that variations of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A marking system, comprising:

a marking station;

a sheet collection station with a signal device, the sheet collection station being positioned downstream of the marking station;

a sheet conveyance path positioned between the marking station and the sheet collection station; and at least two sensors separately positioned along the sheet conveyance path, a first of the at least two sensors being configured to detect a sheet of paper passing the first sensor and to send a signal to activate the signal device;

wherein:

the sheet conveyance path is configured to convey paper along the sheet conveyance path extending from the marking station to the collection station, the first of the at least two sensors is configured along the sheet conveyance path to send the signal to activate the signal device when a first sheet of the paper passes the first of the at least two sensors which is configured to be directly triggered or activated by the first sheet of the paper, a second of the at least two sensors is configured along the sheet conveyance path downstream of the first of the at least two sensors and further configured to send a signal to inactivate the signal device and shut off the signal device at a predetermined or fixed period of time after the first sensor activates the signal device, the second of the at least two sensors sensing passage of the paper to the sheet collection station; and the signal device comprises first, second and third color coded lights, the first, second and third color coded lights being color coded to indicate different conditions for the paper deposited in the collection station, the first color coded light being configured to indicate a first condition for the paper in the collection station, the second color coded light being configured to indicate a second condition for the paper in the collection station, and the third color coded light being configured to indicate a third condition for the paper in the collection station, the first, second and third color coded lights being different colors, and the first, second and third conditions being different conditions for the paper in the collection station.

2. The system of claim 1 wherein the first of the at least two sensors is located downstream of the marking station at a beginning point on the sheet conveyance path and the second of the at least two sensors is located at an end point of the sheet conveyance path at the collection station.

3. The system of claim 1 wherein the signal device is configured to flash to provide an additional means to attract a user's attention.

4. The system of claim 1 wherein the first and second of the at least two sensors in the sheet conveyance path are selected from a group consisting of electronic sensors, optical sensors, mechanical sensors, and combinations of those sensors.

5. The system of claim 1 wherein the system comprises a machine selected from a group consisting of multi-function machines, printers, duplicators, and facsimile machines.

6. A printing apparatus comprising in operative relationship:

at least two sensors;

at least one marking station;

a sheet conveyance path configured to move a marked sheet from the at least one marking station to a collection station, the sheet conveyance path being positioned between the at least one marking station and the collection station; and a light source in operative contact with at least one of the at least two sensors which is configured as a signal device to illuminate the collection station to indicate the presence of at least one finished marked sheet in the collection station, wherein:

a first of the at least two sensors is positioned at an upstream end of the sheet conveyance path in a vicinity of the marking station and a second of the at least two sensors is positioned at a downstream end of the sheet conveyance path in a vicinity of the collection station, the first of the at least two sensors is configured to be activated upon direct contact with the marked sheet and to generate a signal to turn on the signal device, the second of the at least two sensors is configured sense passage of at least one marked sheet and to generate a signal to turn off the signal device at a preset time after the marked sheet passes through the second of the at least two sensors, and the signal device comprises first, second and third color coded lights, the first, second and third color coded lights being color coded to indicate different conditions for the paper deposited in the collection station, the first color coded light being configured to indicate a first condition for the paper in the collection station, the second color coded light being configured to indicate a second condition for the paper in the collection station, and the third color coded light being configured to indicate a third condition for the paper in the collection station, the first, second and third color coded lights being different colors, and the first, second and third conditions being different conditions for the paper in the collection station.

7. The apparatus of claim 6 wherein the system comprises a machine selected from a group consisting of multi-function machines, printers, duplicators, and facsimile machines.

* * * * *